US012291800B2

(12) United States Patent
Ogino et al.

(10) Patent No.: US 12,291,800 B2
(45) Date of Patent: May 6, 2025

(54) METHOD OF PRODUCING MELT-ANISOTROPIC AROMATIC POLYESTER MULTIFILAMENT

(71) Applicant: KURARAY CO., LTD., Kurashiki (JP)

(72) Inventors: Yuji Ogino, Saijo (JP); Takuji Nakamura, Osaka (JP); Kota Togii, Saijo (JP)

(73) Assignee: KURARAY CO., LTD., Kurashiki (JP)

( * ) Notice: Subject to any disclaimer, the term of this patent is extended or adjusted under 35 U.S.C. 154(b) by 0 days.

(21) Appl. No.: 18/335,474

(22) Filed: Jun. 15, 2023

(65) Prior Publication Data

US 2023/0323570 A1 Oct. 12, 2023

Related U.S. Application Data

(63) Continuation of application No. 17/009,896, filed on Sep. 2, 2020, now abandoned, which is a continuation of application No. PCT/JP2019/008039, filed on Mar. 1, 2019.

(30) Foreign Application Priority Data

Mar. 7, 2018 (JP) ..... 2018-040771

(51) Int. Cl.

| | |
|---|---|
| ***D01D 10/02*** | (2006.01) |
| ***D01D 10/04*** | (2006.01) |
| ***D01F 6/62*** | (2006.01) |
| ***D01F 8/14*** | (2006.01) |
| ***D06B 1/02*** | (2006.01) |
| ***D06B 3/04*** | (2006.01) |
| ***D06B 3/06*** | (2006.01) |
| ***D06M 15/643*** | (2006.01) |
| *D06M 101/32* | (2006.01) |

(52) U.S. Cl.

CPC ..... *D01F 8/14* (2013.01); *D01D 10/0409* (2013.01); *D01D 10/0427* (2013.01); *D01F 6/62* (2013.01); *D06M 15/643* (2013.01); *D06M 2101/32* (2013.01); *D06M 2200/35* (2013.01); *D10B 2331/04* (2013.01)

(58) Field of Classification Search

CPC ..... D01F 8/14; D01F 6/62; D06M 15/643; D06M 2101/32; D06M 2200/35; D01D 10/02; D01D 10/0409; D01D 10/0427; D06B 1/02; D06B 3/04; D06B 5/06; D10B 2331/04

USPC ..... 428/374; 264/211.14, 211.15, 211.17, 264/234, 345; 8/115.51, 115.56, 115.6, 8/115.64

See application file for complete search history.

(56) References Cited

U.S. PATENT DOCUMENTS

| | | | | |
|---|---|---|---|---|
| 4,062,999 | A * | 12/1977 | Kondo | D06M 15/6436 428/394 |
| 4,725,635 | A | 2/1988 | Okada et al. | |
| 8,607,539 | B2 | 12/2013 | Uehata et al. | |
| 8,673,174 | B2 | 3/2014 | Funatsu et al. | |
| 9,011,743 | B2 | 4/2015 | Funatsu et al. | |
| 2010/0104870 | A1 | 4/2010 | Funatsu et al. | |
| 2011/0009550 | A1 | 1/2011 | Uehata et al. | |
| 2011/0318982 | A1 | 12/2011 | Funatsu et al. | |
| 2015/0004409 | A1 | 1/2015 | Sakae et al. | |

FOREIGN PATENT DOCUMENTS

| | | | | |
|---|---|---|---|---|
| CN | 87 1 03755 | A | 12/1987 | |
| CN | 101977999 | A | 2/2011 | |
| CN | 102348841 | A | 2/2012 | |
| CN | 103122493 | A | 5/2013 | |
| CN | 104024495 | A | 9/2014 | |
| EP | 2 407 583 | A1 | 1/2012 | |
| JP | 4-24289 | A | 1/1992 | |
| JP | 11-1109 | A | 1/1999 | |
| JP | 11-269737 | A | 10/1999 | |
| JP | 2010-196221 | A | 9/2010 | |
| JP | 2013-133576 | A | 7/2013 | |
| TW | 221465 | B | 3/1994 | |
| WO | WO 2013/099863 | A | 7/2013 | |
| WO | WO-2013099863 | A1 * | 7/2013 | C08G 63/605 |

OTHER PUBLICATIONS

Technical Data of Dowsil HS 200 Fluid (5 cst—300000 cst) polysiloxane (Year: 2008).*

"Dynamic of Fibre Formation and Processing", by Roland Beyreuther, 2010. (Year: 2010).*

International Search Report issued Jun. 4, 2019 in PCT/JP2019/008039 filed Mar. 1, 2019, 1 page.

International Preliminary Report on Patentability and Written Opinion issued Sep. 17, 2020 in PCT/JP2019/008039 (submitting English translation only), 6 pages.

Notice of Reasons for Refusal issued Aug. 24, 2021 in Japanese Patent Application No. 2020-504975 (with English machine translation), 6 pages.

Notification of Reason for Refusal issued Oct. 20, 2021 in Korean Patent Application No. 10-2020-7025082 (with English machine translation), 10 pages.

Extended European Search Report issued Oct. 27, 2021 in European Patent Application No. 19763707.7, 7 pages.

(Continued)

*Primary Examiner* — Leo B Tentoni

(74) *Attorney, Agent, or Firm* — Oblon, McClelland, Maier & Neustadt, L.L.P.

(57) ABSTRACT

Provided is a melt-anisotropic aromatic polyester multifilament having excellent abrasion resistance. The melt-anisotropic aromatic polyester multifilament has a single fiber fineness from 10 to 80 dtex and comprises 3 to 10 wt % of a dimethylsilicone-series finishing agent applied on a fiber surface of the multifilament, based on the multifilament, the finishing agent containing a dimethylsilicone-series compound having a weight average molecular weight from 15000 to 40000.

20 Claims, No Drawings

(56) References Cited

OTHER PUBLICATIONS

Combined Chinese Office Action and Search Report issued Jun. 6, 2022, in corresponding Chinese Patent Application No. 201980016970.1 (with English Translation and English Translation of Category of Cited Documents) 13 pages.
Technical Data of Dowsil SH200 Fluid (Year: 2013).

* cited by examiner

METHOD OF PRODUCING MELT-ANISOTROPIC AROMATIC POLYESTER MULTIFILAMENT

CROSS REFERENCE TO THE RELATED APPLICATION

This application is a continuation application, under 35 U.S.C. § 111 (a), of application Ser. No. 17/009,896, abandoned, filed Sep. 2, 2020, which is a continuation application, under 35 U.S.C § 111 (a) of international application No. PCT/JP2019/008039, filed Mar. 1, 2019, which claims priority to Japanese patent application No. 2018-040771, filed Mar. 7, 2018, the entire disclosures of all of which are herein incorporated by reference as a part of this application.

BACKGROUND OF THE INVENTION

Field of Invention

The present invention relates to a melt-anisotropic aromatic polyester multifilament having excellent abrasion resistance.

Description of Related Art

Melt-anisotropic aromatic polyester has been known as a polymer having a rigid molecular chain that is melt-spinnable to obtain fibers capable of exhibiting the highest tenacity and elastic modulus among melt-spinnable fibers because melt spinning makes the melt-anisotropic aromatic polyester have highly oriented molecular chains in a fiber axial direction and heat treatment attains solid-phase polymerization. It is also known that solid-phase polymerization increases the molecular weight and the melting point of the melt-anisotropic aromatic polyester fibers so as to enhance heat resistance and dimensional stability of the fibers. Thus, the melt-anisotropic aromatic polyester fibers subjected to solid-phase polymerization can exhibit high tenacity, high elastic modulus, excellent heat resistance, and dimensional stability.

In addition to the above properties, the melt-anisotropic aromatic polyester fibers have high chemical resistance and low hygroscopicity. Thus, the melt-anisotropic aromatic polyester fibers are used in applications including control cables, tension members (such as optical fibers, electric wires, head corns), cord reinforcing members for various electrical appliances, core yarns of heater wires, sailcloth, ropes, protective gloves, and reinforcing members for plastics. Because of its particularly excellent abrasion resistance, the melt-anisotropic aromatic polyester fibers are also used in applications including climbing ropes, land nets (such as safety nets, nets used in golf practice ranges), lifelines, fishing lines, fishing nets, longlines, and slings.

Patent Document 1 (JP Laid-open Patent Publication No. 2013-133576) describes that melt spinning of a melt-anisotropic aromatic polyester containing a certain amount of a metallic soap can produce multifilaments which have reduced unevenness between single fibers of the multifilaments, high tenacity, high elastic modulus, excellent heat resistance and dimensional stability, less fluff, and excellent fiber application processability, and can produce fibers that can be suitably used in applications such as ropes, fishing nets, and slings.

SUMMARY OF THE INVENTION

Problems to be Solved by the Invention

In Patent Document 1, however, the production method may lead to generation of fluff in a rewinding process after a solid-phase polymerization process because the method involves application of an oiling agent before the solid-phase polymerization process, which may result in decomposition of the oiling agent during the solid-phase polymerization process depending on the type of the oiling agent. Also, even where such an oiling agent is not decomposed, the oiling agent may be transferred or removed due to evaporation of an oiling-agent-containing component or heat convection caused by heat applied during the solid-phase polymerization process, so that uneven distribution of the oiling agent may be caused after the solid-phase polymerization process. Therefore, thus-obtained melt-anisotropic aromatic polyester multifilaments have insufficient abrasion resistance.

The present invention presents a solution to such problems of the conventional techniques and provides a melt-anisotropic aromatic polyester multifilament having excellent abrasion resistance.

Means for Solving the Problems

In order to improve abrasion resistance of a melt-anisotropic aromatic polyester multifilament, the inventors of the present invention have made extensive study and have found that where a specific amount of a dimethylsilicone-series finishing agent containing a dimethylsilicone-series compound having a specific molecular weight is applied to surfaces of a melt-anisotropic aromatic polyester multifilament each having a specific large single fiber fineness, surprisingly, such a melt-anisotropic aromatic polyester multifilament can exhibit markedly improved abrasion resistance while maintaining its tenacity, compared to that of a conventional multifilament of single fibers having small fineness. The inventors thus achieved the present invention.

That is, the present invention may include the following aspects.

Aspect 1

A melt-anisotropic aromatic polyester multifilament having a single fiber fineness from 10 to 80 dtex (preferably from 10 to 60 dtex, and more preferably from 15 to 50 dtex), the melt-anisotropic aromatic polyester multifilament comprising 3 to 10 wt % (preferably 3 to 8 wt %, and more preferably 4 to 6 wt %) of a dimethylsilicone-series finishing agent applied on a fiber surface of the multifilament, based on the multifilament, the finishing agent containing a dimethylsilicone-series compound having a weight average molecular weight from 15000 to 40000 (preferably from 18000 to 35000, and more preferably from 20000 to 30000).

Aspect 2

The melt-anisotropic aromatic polyester multifilament according to aspect 1, wherein the melt-anisotropic aromatic polyester multifilament has a tenacity of 20 cN/dtex or higher (preferably 21 cN/dtex or higher, and more preferably 23 cN/dtex or higher).

Aspect 3

The melt-anisotropic aromatic polyester multifilament according to aspect 1 or 2, wherein the melt-anisotropic aromatic polyester multifilament includes single fibers having an average fiber diameter from 30 to 85 μm (preferably from 33 to 80 μm, and more preferably from 35 to 70 μm).

Aspect 4

The melt-anisotropic aromatic polyester multifilament according to any one of aspects 1 to 3, wherein the dimethylsilicone-series finishing agent has a viscosity from 300 to 3000 $mm^2/s$ (preferably from 300 to 2000 $mm^2/s$, and more preferably from 300 to 1500 $mm^2/s$).

Aspect 5

The melt-anisotropic aromatic polyester multifilament according to any one of aspects 1 to 4, wherein the melt-anisotropic aromatic polyester multifilament has an interfiber dynamic friction coefficient from 0.080 to 0.150 (preferably from 0.085 to 0.140, and more preferably from 0.090 to 0.130).

Aspect 6

A fiber structure comprising a melt-anisotropic aromatic polyester multifilament as recited in any one of aspects 1 to 5 in at least a part of the fiber structure.

As used herein, the term "melt-anisotropic aromatic polyester multifilament" refers to a melt-anisotropic aromatic polyester multifilament on which a dimethylsilicone-series finishing agent is applied. Therefore, for the sake of convenience, the plain term "multifilament (plain multifilament)" is used to refer to a multifilament alone not including a dimethylsilicone-series finishing agent, whereas the term "melt-anisotropic aromatic polyester multifilament" is used to refer to a multifilament including a dimethylsilicone-series finishing agent.

Any combination of at least two constructions, disclosed in the appended claims and/or the specification should be construed as included within the scope of the present invention. In particular, any combination of two or more of the appended claims should be equally construed as included within the scope of the present invention.

Effect of the Invention

The present invention can provide a melt-anisotropic aromatic polyester multifilament having excellent abrasion resistance. The melt-anisotropic aromatic polyester multifilament of the present invention may be suitably used for fiber structure applications such as ropes, cords, and particularly slings.

DESCRIPTION OF THE EMBODIMENTS

Hereinafter, the present invention will be described in detail.

Melt-Anisotropic Aromatic Polyester

A multifilament made of a melt-anisotropic aromatic polyester may be obtained by melt-spinning of the melt-anisotropic aromatic polyester. The melt-anisotropic aromatic polyester may comprise repeating structural units originating from, for example, aromatic diols, aromatic dicarboxylic acids, aromatic hydroxycarboxylic acids, etc. As long as the effect of the present invention is not spoiled, the repeating structural units originating from aromatic diols, aromatic dicarboxylic acids, and aromatic hydroxycarboxylic acids are not limited to a specific chemical composition. The melt-anisotropic aromatic polyester may include the structural units originating from aromatic diamines, aromatic hydroxy amines, or aromatic aminocarboxylic acids in the range which does not spoil the effect of the present invention. For example, preferable structural units may include units shown in Table 1.

TABLE 1

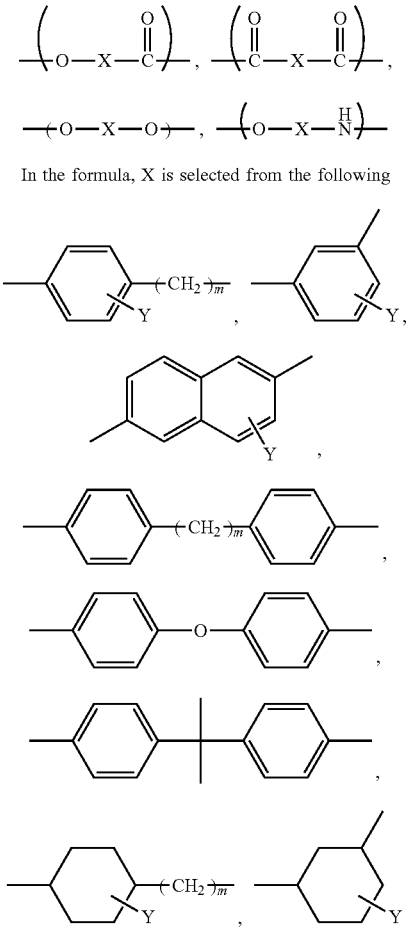

In the formula, X is selected from the following m is an integer from 0 to 2, Y is a substituent selected from hydrogen atom, halogen atoms, alkyl groups, aryl groups, aralkyl groups, alkoxy groups, aryloxy groups, aralkyloxy groups.

In the structural units in Table 1, m is an integer from 0 to 2, and Y in the formula independently represents, as from one substituent to the number of substituents in the range of the replaceable maximum number of aromatic ring, a hydrogen atom, a halogen atom (for example, fluorine atom, chlorine atom, bromine atom and iodine atom), an alkyl group (for example, an alkyl group having 1 to 4 carbon atoms such as methyl group, ethyl group, isopropyl group and t-butyl group), an alkoxy group (for example, methoxy group, ethoxy group, isopropoxy group, n-butoxy group, etc.), an aryl group (for example, phenyl group, naphthyl group, etc.), an aralkyl group (for example, benzyl group (phenylmethyl group), phenethyl group (phenylethyl group), etc.), an aryloxy group (for example, phenoxy group etc.), an aralkyloxy group (for example, benzyloxy group etc.), and others.

As more preferable structural units, there may be mentioned structural units as described in Examples (1) to (18)

shown in the following Tables 2, 3, and 4. It should be noted that where the structural unit in the formula is a structural unit which can show a plurality of structures, combination of two or more units may be used as structural units for a polymer.
TABLE 2
(1)
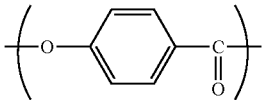
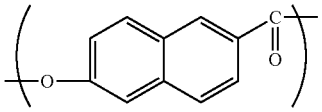
(2)
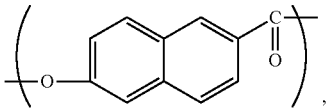
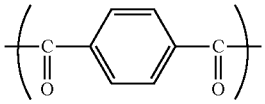
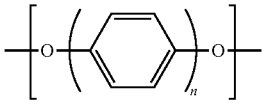
(3)
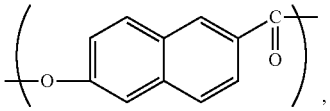
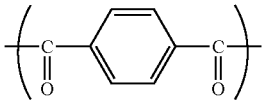
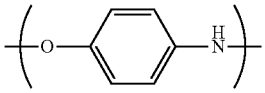
(4)
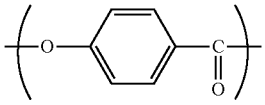
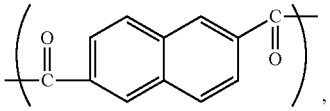
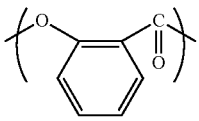
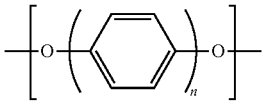
(5)
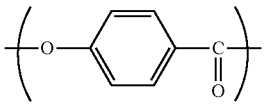
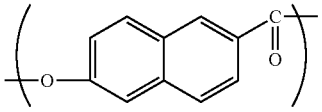
TABLE 2-continued
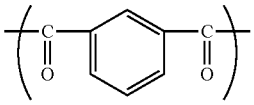
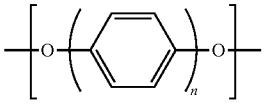
(6)
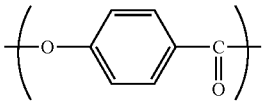
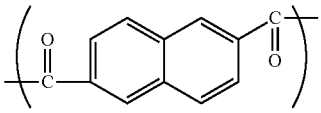
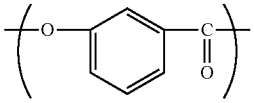
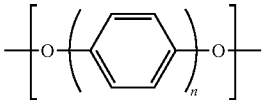
(7)
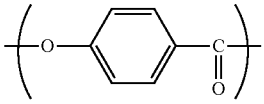
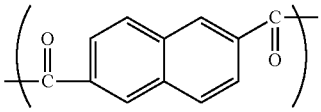
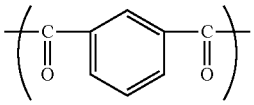
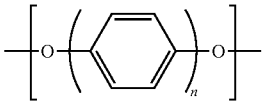
(8)
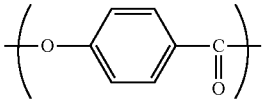
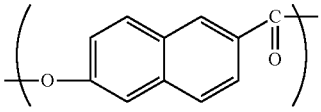
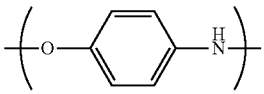
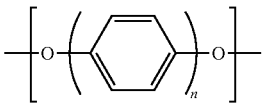
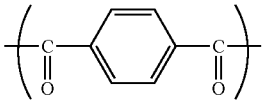

TABLE 3
(9)
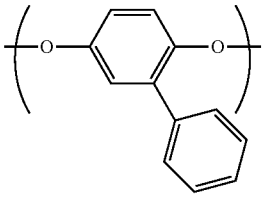
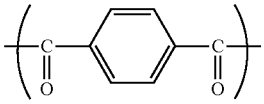
(10)
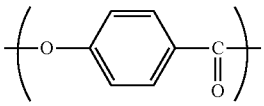
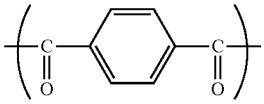
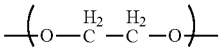
(11)
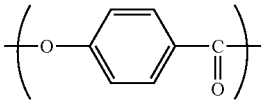
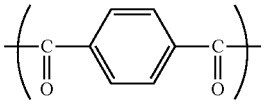
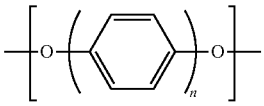
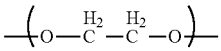
(12)
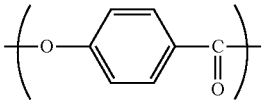
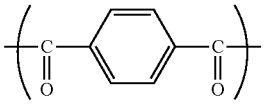
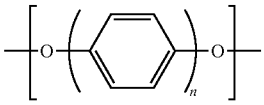
(13)
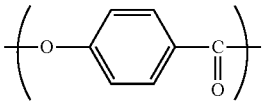
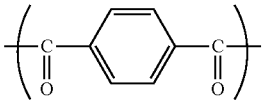
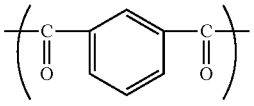
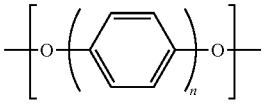
TABLE 3-continued
(14)
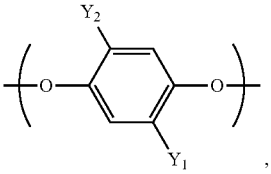
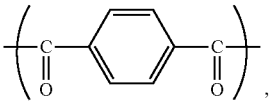
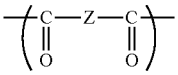
(15)
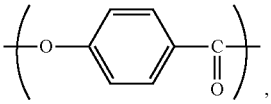
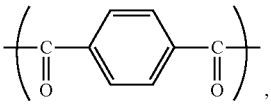
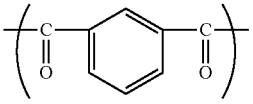
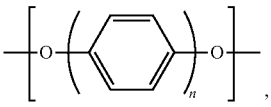
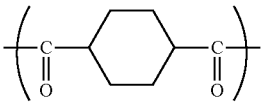
TABLE 4
(16)
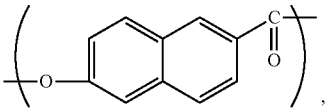
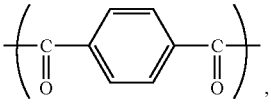
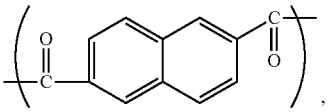
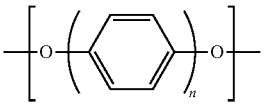
(17)
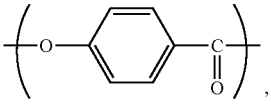

TABLE 4-continued

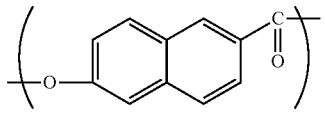

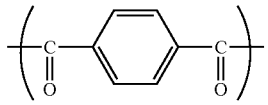

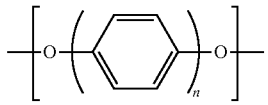

(18)

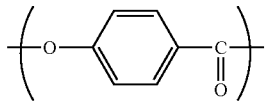

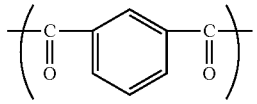

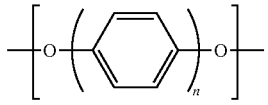

In the structural units shown in Tables 2, 3, and 4, n is an integer of 1 or 2, among each of the structural units, n=1 and n=2 may independently exist, or may exist in combination; each of the Y1 and Y2 independently represents, a hydrogen atom, a halogen atom, (for example, fluorine atom, chlorine atom, bromine atom, iodine atom, etc.), an alkyl group (for example, an alkyl group having 1 to 4 carbon atoms such as methyl group, ethyl group, isopropyl group, and t-butyl group, etc.), an alkoxy group (for example, methoxy group, ethoxy group, and isopropoxy group, n-butoxy group, etc.), an aryl group (for example, phenyl group, naphthyl group, etc.), an aralkyl group (for example, benzyl group (phenylmethyl group), phenethyl group (phenylethyl group), etc.), an aryloxy group (for example, phenoxy group etc.), an aralkyloxy group (for example, benzyloxy group etc.), and others. Among these, the preferable Y may include a hydrogen atom, a chlorine atom, a bromine atom, and a methyl group.

Z may include substitutional groups denoted by following formulae.

Chem. 1

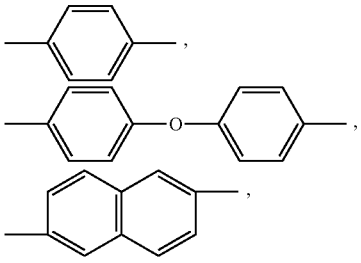

-continued

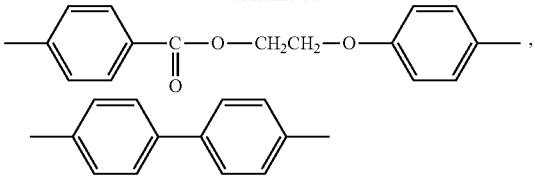

Preferable melt-anisotropic aromatic polyesters may comprise a combination of a structural unit having a naphthalene skeleton. Especially preferable one may include both the structural unit (A) derived from hydroxybenzoic acid and the structural unit (B) derived from hydroxy naphthoic acid. For example, the structural unit (A) may have a following formula (A), and the structural unit (B) may have a following formula (B). In order to improve melt-formability, the ratio of the structural unit (A) and the structural unit (B) may preferably be in a range of former/latter of 9/1 to 1/1, more preferably from 7/1 to 1/1, and still preferably from 5/1 to 1/1.

Chem. 2

(A)

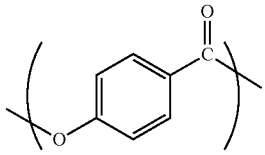

Chem. 3

(B)

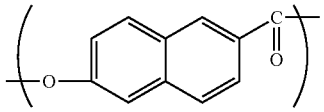

The total proportion of the structural units of (A) and (B) may be, based on all the structural units, for example, 65 mol % or higher, more preferably 70 mol % or higher, and further preferably 80 mol % or higher. A melt-anisotropic aromatic polyester having the structural unit (B) at a proportion of 4 to 45 mol % is especially preferred among polymers.

The melt-anisotropic aromatic polyester suitably used in the present invention preferably has a melting point (hereinafter, sometimes referred to as Mp) in the range from 250 to 360° C., and more preferably from 260 to 320° C. As used herein, the melting point refers to a main absorption peak temperature determined and observed in accordance with JIS K 7121 test method, using a differential scanning calorimeter (DSC; "TA3000" manufactured by Mettler-Toledo International Inc.). Specifically, a melting point is determined as the position of an endothermic peak that occurs when a sample (10 to 20 mg) introduced to an aluminum pan in the DSC device is subjected to temperature increase at a rate of 20° C./min, with nitrogen as a carrier gas flowing at 100 cc/min. Depending on the type of the polymer, where a clear peak does not appear during the 1st run of the DSC measurement, the temperature is increased at a temperature increase rate of 50° C./min to a temperature higher than an expected flowing temperature by 50° C., retained at that temperature for 3 minutes to completely melt the polymer, and then decreased to 50° C. at a temperature decrease rate of 80° C./min. Thereafter, an endothermic peak is measured at a temperature increase rate of 20° C./min.

The above melt-anisotropic aromatic polyester may be added with thermoplastic polymers, such as a polyethylene terephthalate, a modified-polyethylene terephthalate, a polyolefin, a polycarbonate, a polyamide, a polyphenylene sulfide, a polyether ether ketone, a fluoro-resin, and others, as long as they do not spoil the effect of the present invention. Additives may also be added, including inorganic substances such as titanium oxide, kaolin, silica, and barium oxide; carbon black; a colorant such as dyes and paints; an antioxidant; an ultraviolet-ray absorbent; and a light stabilizer Melt-Anisotropic Aromatic Polyester Multifilament It is important that a melt-anisotropic aromatic polyester multifilament of the present invention have a single fiber fineness from 10 to 80 dtex in order to have high tenacity and improved abrasion resistance. In the present invention, it has been found that unexpectedly, abrasion resistance of the melt-anisotropic aromatic polyester multifilament can be markedly improved by using fibers each having a single fiber fineness in a specific range. Where a same finishing agent is applied to melt-anisotropic aromatic polyester multifilaments with different single fiber fineness from each other, it has been found that abrasion resistance of the melt-anisotropic aromatic polyester multifilament with a single fiber fineness of 10 dtex or higher is markedly improved. Although abrasion resistance is improved as the single fiber fineness increases over this value, the melt-anisotropic aromatic polyester multifilament with too large single fiber fineness tends to have reduced abrasion resistance. The reason is not clear why abrasion resistance is improved where the single fiber fineness is 10 dtex or higher. On the other hand, as the single fiber fineness increases, tensile strength tends to decrease. Too large single fiber fineness of melt-anisotropic aromatic polyester multifilaments tends to deteriorate abrasion resistance presumably because the effect of improving abrasion resistance is cancelled out due to the decrease in tensile strength. Further, the multifilament with a single fiber fineness exceeding 80 dtex has difficulty in bundling, and thus, for example, the multifilament wound into a square end shape tends to easily collapse at its end face in a spinning step or a rewinding step. The single fiber fineness may more preferably be from 10 to 60 dtex, and further preferably from 15 to 50 dtex.

The melt-anisotropic aromatic polyester multifilament of the present invention may have an average single fiber diameter from 30 to 85 μm in order to have high tenacity and improved abrasion resistance. The average single fiber diameter may preferably be from 33 to 80 μm, and more preferably from 35 to 70 μm. It should be noted that an average single fiber diameter is determined in accordance with the method described later in Examples and is a value calculated from single fiber finenesses, assuming that the cross section of each fiber is a perfect circle. A specific gravity used in the calculation may be determined by a known method.

The melt-anisotropic aromatic polyester multifilament of the present invention may include 5 to 5000 filaments. Where the number of filaments in the melt-anisotropic aromatic polyester multifilament is too small, the multifilament may not be able to withstand a winding tension and be broken therefor. Where the number of filaments is too large, the multifilament may be difficult to normally wind using a winding machine because the multifilament is too thick.

Further, the multifilament may preferably have a total fineness from 50 to 400000 dtex. Where the total fineness is too small, the multifilament may not be able to withstand a tension during processing and be broken therefor. Where the total fineness is too large, the multifilament may be difficult to normally wind using a winding machine because the multifilament is too thick.

It is important that the melt-anisotropic aromatic polyester multifilament of the present invention include 3 to 10 wt % of a specific dimethylsilicone-series finishing agent applied to a fiber surface based on the multifilament. More preferably 3 to 8 wt % and further preferably 4 to 6 wt % of the finishing agent may be applied to the multifilament. It may be difficult to coat the entire fiber surface with the finishing agent in a proportion of less than 3 wt %, so that the finishing agent is unevenly applied, resulting in insufficient abrasion resistance. On the other hand, where the amount of the finishing agent exceeds 10 wt %, the finishing agent accumulated on surfaces of guides, rollers and the like causes deterioration in process passableness or a handling property of a product cheese, so that productivity may be lowered.

Although it is not clear why application of a specific dimethylsilicone-series finishing agent can remarkably improve abrasion resistance of the melt-anisotropic aromatic polyester multifilament of the present invention, it is presumed that one of the reasons is that the dimethylsilicone-series finishing agent is applied so as to form a coating on the outer surface of the multifilament and is distributed so as to converge the filaments together by covering the respective filaments of the multifilament. In such a case, the dimethylsilicone-series finishing agent permeates into the converged filaments so as to coat the respective filaments and suppresses abrasion between the filaments, improving abrasion resistance.

The melt-anisotropic aromatic polyester multifilament of the present invention may have a tenacity of 20 cN/dtex or higher. The melt-anisotropic aromatic polyester multifilament with too low tenacity may require large fineness and/or an increased number of filaments in order to obtain a desired strength for, e.g., sling belt applications because low tenacity of the melt-anisotropic aromatic polyester multifilament may lead to a thick and heavy sling belt. Where the tenacity is 20 cN/dtex or higher, however, it is possible to obtain a multifilament that meets a required strength for, e.g., sling belt applications, even if the multifilament has a small fineness and a small number of filaments. Thus, it is possible to make a sling belt thin and lightweight. The tenacity may more preferably be 21 cN/dtex or higher, and further preferably 23 cN/dtex or higher. Although there is no specific upper limit, the tenacity may preferably be 40 cN/dtex or lower, and more preferably 35 cN/dtex or lower. It should be noted that the tenacity refers to a tensile strength and may be determined in accordance with the method described later in Examples.

In order to improve abrasion resistance, the melt-anisotropic aromatic polyester multifilament of the present invention may preferably have an interfiber dynamic friction coefficient from 0.080 to 0.150, more preferably from 0.085 to 0.140, and further preferably from 0.090 to 0.130 in a state where the finishing agent is applied thereto, when measured in accordance with the measurement method as described later.

Dimethylsilicone-Series Finishing Agent

It is important that a dimethylsilicone-series finishing agent be used as a finishing agent for the melt-anisotropic aromatic polyester multifilament of the present invention in order to improve abrasion resistance. As long as the dimethylsilicone-series finishing agent contains a dimethylsilicone-series compound as a main component, and the dimethylsilicone-series compound has a dimethyl polysiloxane structure in its chemical structure, the dimethylsilicone-series finishing agent is not particularly limited and may have a part of a side chain or a terminal that is modified with a functional group different from a methyl group. The dimethylsilicone-series finishing agent may also contain various additives such as surfactants, penetrants, antistatic agents, and antibacterial agents, in addition to the dimethylsilicone-series compound. It is important that the dimethylsilicone-series compound have a weight average molecular weight from 15000 to 40000, more preferably from 18000 to 35000, and further preferably from 20000 to 30000. Where the weight average molecular weight is lower than 15000, sufficient coating strength may not be obtained on the fiber surface, resulting in insufficient abrasion resistance. Where the weight average molecular weight exceeds 40000, the viscosity of the finishing agent may become too high, making it difficult to uniformly apply the finishing agent over the fiber surface. It should be noted that the weight average molecular weight of the dimethylsilicone-series compound may be determined as a weight average molecular weight based on polystyrene in gel permeation chromatography (GPC).

Further, the dimethylsilicone-series finishing agent may preferably have a viscosity from 300 to 3000 $mm^2/s$. Where the viscosity is too low, such a viscosity would lower the interfiber dynamic friction coefficient and make it easy to apply the finishing agent over the fiber surface, whereas the finishing agent may be easily fall off from the fiber surface due to friction between the fibers, resulting in poor abrasion resistance. Where the viscosity is too high, the finishing agent may not be able to accommodate the frictional movement of fibers and thus to reduce abrasion of the single fibers because of an increased dynamic friction coefficient, resulting in poor abrasion resistance. The viscosity may more preferably be from 300 to 2000 $mm^2/s$, and further preferably from 300 to 1500 $mm^2/s$. As used herein, the viscosity refers to a kinematic viscosity and may be determined in accordance with JIS Z 8803 using, for example, an Ubbelohde viscometer.

A method of producing a melt-anisotropic aromatic polyester multifilament of the present invention may at least comprise: producing as-spun filaments of a melt-anisotropic aromatic polyester; heat-treating the as-spun filaments; and applying a specific dimethylsilicone-series finishing agent to the heat-treated multifilament in a proportion of 3 to 10 wt % of based on the multifilament.

The as-spun filaments of the melt-anisotropic aromatic polyester are not particularly limited in terms of the method of fiberizing and may usually be fibers obtained by melt spinning Melt spinning may be performed by a known or conventional method. For example, fibers may be obtained by melting a fiber-formable resin for liquid crystal polyester fibers in an extruder and discharging the melt from a nozzle at a predetermined spinning temperature.

Tenacity as well as elastic modulus of the melt-anisotropic aromatic polyester fibers of the present invention can further be enhanced by subjecting the as-spun filaments to heat treatment. Heat treatment may preferably be performed at a temperature in a range from (Mp-80) to (Mp)° C. The heat treatment temperature may be, for example, more preferably from (Mp-50) to (Mp)° C., and further preferably from (Mp-30) to (Mp-1)° C. Since the melting point of the melt-anisotropic aromatic polyester fibers of the present invention increases along with as the heat treatment temperature increase, a preferable heat treatment process may involve performing heat treatment at stepwisely increased temperatures. As a heat treatment atmosphere, an inert gas such as nitrogen and argon, or an active gas such as air, or a combination thereof may suitably be used. Heat treatment may be performed under a reduced pressure.

Heat treatment may be performed to the multifilament wound on a metal bobbin in the form of a package or the multifilament in the form of a skein (hank) or a tow, or may be continuously performed to the multifilament between rollers. In order to simplify equipment and improve productivity, it is preferable to perform heat treatment to the multifilament wound in the form of a package.

A process of applying 3 to 10 wt % of the dimethylsilicone-series finishing agent to the heat-treated multifilament based on the weight of the multifilament is not particularly limited as long as a specific amount of the dimethylsilicone-series finishing agent can be applied to the multifilament. For example, any known application method may be used including impregnation treatment, discharge treatment, coating treatment, and impregnation and squeezing treatment. In order to adjust the application amount, discharge (spray) treatment, coating treatment, and impregnation and squeezing treatment are preferably carried out in such a way that the finishing agent is applied to the traveling filaments during rewinding of the heat-treated multifilament. Since the application of the dimethylsilicone-series finishing agent to the heat-treated multifilament can suppress decomposition or transfer of the dimethylsilicone-series finishing agent due to heat treatment, it is possible to apply the finishing agent so as to form a coating on the surface of the multifilament.

As long as a specific amount of the dimethylsilicone-series finishing agent can be applied to the multifilament, the dimethylsilicone-series finishing agent may take any form when the finishing agent is applied. The dimethylsilicone-series compound may be applied in the form of a stock solution or a diluted solution (for example, emulsion). It should be noted that the application amount of the dimethylsilicone-series finishing agent based on the weight of the multifilament does not include an amount of a solvent used for dilution.

The melt-anisotropic aromatic polyester multifilament of the present invention may be suitably used for various fiber structures. As used herein, the fiber structure includes ropes, nets, fishing nets, sling belts, tension members and the like which are composed of fibers of the present invention. The fiber structure may be made only of the melt-anisotropic aromatic polyester multifilaments or include other constituting components in the range which does not spoil the effect of the present invention. Preferably, the fiber structure may be suitably used for ropes and sling belts that require particularly high abrasion resistance because high load is applied due to the nature of the intended use.

EXAMPLES

Hereinafter, the present invention will be described more specifically in conjunction with Examples, which are not intended to limit the present invention in any way whatsoever.

Single Fiber Fineness, Total Fineness, Average Single Fiber Diameter, Tenacity, Strength A single fiber fineness and a total fineness of a multifilament were measured in accordance with JIS L 1013. An average single fiber diameter was calculated from the measured single fiber fineness and a specific gravity (1.41 $g/cm^3$) of a melt-anisotropic aromatic polyester used in Examples and Comparative Examples.

Measurement of a tenacity and a strength of the melt-anisotropic aromatic polyester multifilament was performed in accordance with JIS L 1013 under the conditions of a length of 20 cm, an initial load of 0.098 cN/dtex, and a tensile speed of 10 cm/min to determine a breaking strength (tensile strength). An average was taken from measurements at 5 or more locations.

Amount of Finishing Agent Applied

An amount of a finishing agent applied was determined by the following method. A 10-m sample of a multifilament after being subjected to heat treatment and before applying the finishing agent was prepared using a wrap reel. A weight of the sample at this stage was measured and denoted as "a" (g). Next, a 10-m sample of a melt-anisotropic aromatic polyester multifilament after applying the finishing agent during rewinding was prepared in the same manner A weight of the sample at this stage was measured and denoted as "b" (g). The amount of the finishing agent applied was calculated by the following formula (1).

$$\text{Amount of finishing agent applied(wt \%)}=(b-a)/a\times 100 \quad (1)$$

Interfiber Dynamic Friction Coefficient

An interfiber dynamic friction coefficient was determined by the following method using a Roder friction coefficient tester. Two cylindrical test pieces were prepared as duplicates in each of which a melt-anisotropic aromatic polyester multifilament was wound around a cylinder having an outer diameter of 8 mm under an initial load of 0.098 cN/dtex. Next, a test sample having a length of about 150 mm was obtained from the same melt-anisotropic aromatic polyester multifilament. While attaching a weight of 500 mg to each end of the sample, the test sample was hung on one of the cylindrical test pieces, and then one end of the test sample was connected to a hook of a torsion balance. Measurement of the dynamic friction coefficient (μd) was performed by rotating the cylindrical test piece at a speed of 120 rpm (a peripheral speed of 697.2 cm/min in a state where the melt-anisotropic aromatic polyester multifilament was wound) and determining a weight at which the opposite ends of the test sample were balanced using the torsion balance. A single strand of the test sample was used to be hung at a central part of the cylindrical test piece and measured. Then, the cylindrical test piece was moved in a horizontal direction to perform another measurement on a new friction surface using a new test sample in the same manner. The measurement was repeated 5 times for each cylindrical test piece. An average was calculated from the total 10 measurements for the two cylindrical test pieces.

Evaluation of Abrasion Resistance

Abrasion resistance was determined by the following method. A melt-anisotropic aromatic polyester multifilament having a total fineness of 1670 dtex and the number of twists of 80 turns/m was prepared. The melt-anisotropic aromatic polyester multifilament was hung in a loop shape over two pulleys each having a diameter of 50 mm and was fixed so that the pulleys and the melt-anisotropic aromatic polyester multifilament did not slip. The distance between the pulleys was adjusted to 500 mm. The hung melt-anisotropic aromatic polyester multifilament had three twisting portions between the pulleys, and a load of 3 kg was applied to one pulley. Then, the pulley was reciprocated at an angle of 180° in a cycle of 105 times/min so that the melt-anisotropic aromatic polyester multifilament was abraded at the twisting portions so as to count the number of reciprocations of the pulley before the melt-anisotropic aromatic polyester multifilament broke. Evaluation was performed based on the following criteria.

A: 10000 times or more

B: 5000 times or more and less than 10000 times

C: less than 5000 times

Example 1

A melt-anisotropic aromatic polyester (Mp: 281° C.) having the above structural units (A) and (B) in a proportion of (A)/(B)=73/27 (molar ratio) was used as a melt-anisotropic aromatic polyester. The melt-anisotropic aromatic polyester was spun using a single-screw extruder and a nozzle having a hole diameter φ of 0.18 mm and the number of holes of 100H to produce a multifilament of 1670 dtex/100 f (single fiber fineness of 16.7 dtex). The obtained as-spun filaments were rewound on a metal bobbin with many perforations to form a package having a winding density of 0.6 g/cm$^3$ and then were heat-treated for 20 hours under a dry nitrogen atmosphere at 260° C. Thereafter, the obtained package was further rewound with applying a 5.0 wt % of a dimethylsilicone having a weight average molecular weight of 25000 and a viscosity of 1000 mm$^2$/s as a finishing agent to the fibers in the yarn. The fibers were then wound on a paper tube. The tenacity of the obtained melt-anisotropic aromatic polyester multifilament was 25.3 cN/dtex. The interfiber dynamic friction coefficient was 0.109. Further, in the evaluation of abrasion resistance, the pulley was reciprocatingly rotated 17981 times before fiber breakage.

Example 2

As-spun filaments of a multifilament of 1670 dtex/50 f (single fiber fineness of 33.4 dtex) were obtained in the same manner as that of Example 1 except that a nozzle having a hole diameter φ of 0.25 mm and the number of holes of 50H was used in spinning. The obtained as-spun filaments were subjected to heat treatment under the same conditions as those of Example 1 and were rewound with applying the finishing agent in the same manner. The tenacity of the obtained melt-anisotropic aromatic polyester multifilament was 23.6 cN/dtex. The interfiber dynamic friction coefficient was 0.096. Further, in the evaluation of abrasion resistance, the pulley was reciprocatingly rotated 40941 times before fiber breakage.

Example 3

A melt-anisotropic aromatic multifilament of 1670 dtex/100 f (single fiber fineness of 16.7 dtex) was obtained in the same manner as that of Example 1 except that a dimethylsilicone having a weight average molecular weight of 15000 and a viscosity of 300 mm$^2$/s was used as a finishing agent. The tenacity of the obtained melt-anisotropic aromatic polyester multifilament was 25.5 cN/dtex. The interfiber dynamic friction coefficient was 0.144. Further, in the evaluation of abrasion resistance, the pulley was reciprocatingly rotated 13164 times before fiber breakage.

Example 4

As-spun filaments of a multifilament of 1670 dtex/36 f (single fiber fineness of 46.4 dtex) were obtained in the same manner as that of Example 1 except that a nozzle having a hole diameter φ of 0.25 mm and the number of holes of 36H was used in spinning. The obtained as-spun filaments were subjected to heat treatment under the same conditions as those of Example 1 and were rewound with applying the finishing agent in the same manner. The tenacity of the obtained melt-anisotropic aromatic polyester multifilament was 21.1 cN/dtex. The interfiber dynamic friction coefficient was 0.089. Further, in the evaluation of abrasion resistance, the pulley was reciprocatingly rotated 64316 times before fiber breakage.

Comparative Example 1

As-spun filaments of a multifilament of 1670 dtex/300 f (single fiber fineness of 5.6 dtex) were obtained in the same manner as that of Example 1 except that a nozzle having a hole diameter φ of 0.10 mm and the number of holes of 300H was used in spinning. The obtained as-spun filaments were subjected to heat treatment under the same conditions as those of Example 1 and were rewound with applying the finishing agent in the same manner. The tenacity of the obtained melt-anisotropic aromatic polyester multifilament was 26.1 cN/dtex. The interfiber dynamic friction coefficient was 0.158. Further, in the evaluation of abrasion resistance, the pulley was reciprocatingly rotated 1470 times before fiber breakage.

Comparative Example 2

As-spun filaments of a multifilament of 1670 dtex/20 f (single fiber fineness of 83.5 dtex) were obtained in the same manner as that of Example 1 except that a nozzle having a hole diameter φ of 0.40 mm and the number of holes of 20H was used in spinning. The obtained as-spun filaments were subjected to heat treatment under the same conditions as those of Example 1 and were rewound with applying the finishing agent in the same manner. The tenacity of the obtained melt-anisotropic aromatic polyester multifilament was 18.2 cN/dtex. The interfiber dynamic friction coefficient was 0.072. Further, in the evaluation of abrasion resistance, the pulley was reciprocatingly rotated 8948 times before fiber breakage.

Comparative Example 3

A melt-anisotropic aromatic multifilament of 1670 dtex/100 f (single fiber fineness of 16.7 dtex) was obtained in the same manner as that of Example 1 except that the finishing agent was applied at 2.0 wt %. The tenacity of the obtained melt-anisotropic aromatic polyester multifilament was 25.1 cN/dtex. The interfiber dynamic friction coefficient was 0.182. Further, in the evaluation of abrasion resistance, the pulley was reciprocatingly rotated 1360 times before fiber breakage.

Comparative Example 4

A melt-anisotropic aromatic multifilament of 1670 dtex/50 f (single fiber fineness of 33.4 dtex) was obtained in the same manner as that of Example 2 except that the finishing agent was applied at 2.0 wt %. The tenacity of the obtained melt-anisotropic aromatic polyester multifilament was 23.2 cN/dtex. The interfiber dynamic friction coefficient was 0.167. Further, in the evaluation of abrasion resistance, the pulley was reciprocatingly rotated 3745 times before fiber breakage.

Comparative Example 5

A melt-anisotropic aromatic multifilament of 1670 dtex/100 f (single fiber fineness of 16.7 dtex) was obtained in the same manner as that of Example 1 except that a dimethylsilicone having a weight average molecular weight of 6000 and a viscosity of 110 $mm^2/s$ was used as a finishing agent. The tenacity of the obtained melt-anisotropic aromatic polyester multifilament was 25.7 cN/dtex. The interfiber dynamic friction coefficient was 0.069. Further, in the evaluation of abrasion resistance, the pulley was reciprocatingly rotated 4598 times before fiber breakage.

Comparative Example 6

A melt-anisotropic aromatic multifilament of 1670 dtex/100 f (single fiber fineness of 16.7 dtex) was obtained in the same manner as that of Example 1 except that a dimethylsilicone having a weight average molecular weight of 100000 and a viscosity of 9500 $mm^2/s$ was used as a finishing agent. The tenacity of the obtained melt-anisotropic aromatic polyester multifilament was 24.9 cN/dtex. The interfiber dynamic friction coefficient was 0.289. Further, in the evaluation of abrasion resistance, the pulley was reciprocatingly rotated 2299 times before fiber breakage.

Comparative Example 7

As-spun filaments of a multifilament of 1670 dtex/600 f (single fiber fineness of 2.8 dtex) were obtained in the same manner as that of Example 1 except that a nozzle having a hole diameter φ of 0.08 mm and the number of holes of 600H was used in spinning. The obtained as-spun filaments were subjected to heat treatment under the same conditions as those of Example 1 and were rewound with applying the finishing agent in the same manner. The tenacity of the obtained melt-anisotropic aromatic polyester multifilament was 26.3 cN/dtex. The interfiber dynamic friction coefficient was 0.196. Further, in the evaluation of abrasion resistance, the pulley was reciprocatingly rotated 761 times before fiber breakage.

Comparative Example 8

A melt-anisotropic aromatic multifilament of 1670 dtex/100 f (single fiber fineness of 16.7 dtex) was obtained in the same manner as that of Example 1 except that a step of applying 5.0 wt % of a dimethylsilicone having a weight average molecular weight of 25000 and a viscosity of 1000 $mm^2/s$ to the multifilament was performed to as-spun filaments before heat treatment, instead of applying it as a finishing agent after heat treatment. The amount of the dimethylsilicone applied was a proportion of the weight of the dimethylsilicone applied to the as-spun filaments based on the weight of the as-spun filaments of the multifilament and was a value measured before heat treatment. The tenacity of the obtained melt-anisotropic aromatic polyester multifilament was 21.2 cN/dtex. The interfiber dynamic friction coefficient was 0.264. Further, in the evaluation of abrasion resistance, the pulley was reciprocatingly rotated 5380 times before fiber breakage.

TABLE 5

| | Melt-anisotropic aromatic polyester multifilament | | | | | | Dimethylsilicone-series finishing agent | | Evaluation | | |
|---|---|---|---|---|---|---|---|---|---|---|---|
| | Single fiber fineness (dtex) | Single fiber average fiber diameter (μm) | Total fineness (dtex) | Amount of finishing agent applied (wt %) | Tenacity (cN/dtex) | Interfiber dynamic friction coefficient | Weight average molecular weight | Viscosity ($mm^2/s$) | Strength (N) | Abrasion resistance (number of replications before breaking) | |
| Ex. 1 | 16.7 | 38.8 | 1670 | 5 | 25.3 | 0.109 | 25000 | 1000 | 473 | 17981 | A |
| Ex. 2 | 33.4 | 54.9 | 1670 | 5 | 23.6 | 0.096 | 25000 | 1000 | 394 | 40941 | A |
| Ex. 3 | 16.7 | 38.8 | 1670 | 5 | 25.5 | 0.144 | 15000 | 300 | 426 | 13164 | A |
| Ex. 4 | 46.4 | 64.7 | 1670 | 5 | 21.1 | 0.089 | 25000 | 1000 | 352 | 64316 | A |
| Com. Ex. 1 | 5.6 | 22.5 | 1670 | 5 | 26.1 | 0.158 | 25000 | 1000 | 436 | 1470 | C |
| Com. Ex. 2 | 83.5 | 86.8 | 1670 | 5 | 18.2 | 0.072 | 25000 | 1000 | 304 | 8948 | B |
| Com. Ex. 3 | 16.7 | 38.8 | 1670 | 2 | 25.1 | 0.182 | 25000 | 1000 | 419 | 1360 | C |
| Com. Ex. 4 | 33.4 | 54.9 | 1670 | 2 | 23.2 | 0.167 | 25000 | 1000 | 387 | 3745 | C |
| Com. Ex. 5 | 16.7 | 38.8 | 1670 | 5 | 25.7 | 0.069 | 6000 | 110 | 429 | 4598 | C |
| Com. Ex. 6 | 16.7 | 38.8 | 1670 | 5 | 24.9 | 0.289 | 100000 | 9500 | 416 | 2299 | C |
| Com. Ex. 7 | 2.8 | 15.9 | 1670 | 5 | 26.3 | 0.196 | 25000 | 1000 | 439 | 761 | C |
| Com. Ex. 8 | 16.7 | 38.8 | 1670 | —* | 21.2 | 0.264 | —* | —* | 354 | 5380 | B |

*A dimethylsilicone having a weight average molecular weight of 25000 and a viscosity of 1000 $mm^2/s$ was applied at 5 wt % to as-spun filaments before heat treatment.

Table 5 shows the evaluation results. As demonstrated by Examples 1 to 4, the melt-anisotropic aromatic polyester multifilaments each having a single fiber fineness from 10 to 80 dtex and comprising 3 to 10 wt % of a dimethylsilicone having a weight average molecular weight from 15000 to 40000 applied as a finishing agent to the fiber surface of the multifilament show excellent abrasion resistance. The melt-anisotropic aromatic polyester multifilaments of Examples 1 to 4 have a tenacity of 20 cN/dtex or higher.

In contrast, since each of Comparative Examples 1 and 7 has a single fiber fineness less than 10 dtex, Comparative Examples 1 and 7 are broken early because the single fibers are abraded due to interfiber friction in the melt-anisotropic aromatic polyester multifilament. Comparative Example 2 has poor abrasion resistance in comparison with those of Examples 1, 2 and 4 because Comparative Example 2 has a single fiber fineness exceeding 80 dtex. In Comparative Examples 3 and 4, the finishing agent is applied by small amounts, resulting in a higher dynamic friction coefficient. Thus, Comparative Examples 3 and 4 are not able to reduce abrasion of the single fibers and are broken early. In Comparative Example 5, the finishing agent is prone to falling off from the fiber surface due to interfiber friction because the dimethylsilicone has a low weight average molecular weight and the finishing agent has a low viscosity. Thus, Comparative Example 5 is not able to reduce abrasion of the single fibers and is broken early. In Comparative Example 6, the finishing agent is not able to accommodate interfiber friction because the dimethylsilicone has a high weight average molecular weight and the finishing agent has a high viscosity, resulting in a higher dynamic friction coefficient. Thus, Comparative Example 6 is not able to reduce abrasion of the single fibers and is broken early. Comparative Example 8 has poor abrasion resistance in comparison with that of Example 1 because the dimethylsilicone is applied before heat treatment, instead of being applied as a finishing agent after heat treatment.

INDUSTRIAL APPLICABILITY

Melt-anisotropic aromatic polyester fibers having excellent abrasion resistance which can be obtained by the present invention may be suitably used for fiber structure applications such as ropes, cords, and particularly slings.

Although the preferred examples of the present invention have been described, those skilled in the art who read the present specification would arrive at various changes and modifications without departing from the scope of the invention.

Accordingly, such changes and modifications are included within the scope of the present invention defined by the appended claims.

What is claimed is:

1. A method of producing a melt-anisotropic aromatic polyester multifilament, the method comprising:

heat-treating as-spun filaments of a melt-anisotropic aromatic polyester to give a heat-treated multifilament; and applying a dimethylsilicone-series finishing agent to the heat-treated multifilament to produce a melt-anisotropic aromatic polyester multifilament, the melt-anisotropic aromatic polyester multifilament having a single fiber fineness from 10 to 80 dtex, the finishing agent being applied in a proportion of 3 to 10 wt % based on the heat-treated multifilament, the finishing agent containing a dimethylsilicone-series compound having a weight average molecular weight from 15000 to 40000.

2. The method of producing the melt-anisotropic aromatic polyester multifilament according to claim 1, wherein the melt-anisotropic aromatic polyester multifilament has a tenacity of 20 cN/dtex or higher.

3. The method of producing the melt-anisotropic aromatic polyester multifilament according to claim 1, wherein the melt-anisotropic aromatic polyester multifilament includes single fibers having an average fiber diameter from 30 to 85 μm.

4. The method of producing the melt-anisotropic aromatic polyester multifilament according to claim 1, wherein the dimethylsilicone-series finishing agent has a viscosity from 300 to 3000 $mm^2/s$.

5. The method of producing the melt-anisotropic aromatic polyester multifilament according to claim 1, wherein the melt-anisotropic aromatic polyester multifilament has an interfiber dynamic friction coefficient from 0.080 to 0.150.

6. The method of producing the melt-anisotropic aromatic polyester multifilament according to claim 1, wherein the melt-anisotropic aromatic polyester multifilament has a single fiber fineness from 15 to 60 dtex.

7. The method of producing the melt-anisotropic aromatic polyester multifilament according to claim 1, wherein the finishing agent contains a dimethylsilicone-series compound having a weight average molecular weight from 20000 to 40000.

8. The method of producing the melt-anisotropic aromatic polyester multifilament according to claim 1, wherein the melt-anisotropic aromatic polyester multifilament comprises 3 to 8 wt % of the dimethylsilicone-series finishing agent based on the multifilament.

9. The method of producing the melt-anisotropic aromatic polyester multifilament according to claim 1, wherein the melt-anisotropic aromatic polyester multifilament includes single fibers having an average fiber diameter from 35 to 80 μm.

10. The method of producing the melt-anisotropic aromatic polyester multifilament according to claim 1, wherein the melt-anisotropic aromatic polyester multifilament has an interfiber dynamic friction coefficient from 0.085 to 0.140.

11. The method of producing the melt-anisotropic aromatic polyester multifilament according to claim 1, wherein the as-spun filaments of the melt-anisotropic aromatic polyester is heat-treated at a temperature in a range from (Mp-80) to (Mp)° C.

12. The method of producing the melt-anisotropic aromatic polyester multifilament according to claim 1, wherein the melt-anisotropic aromatic polyester multifilament includes single fibers having an average fiber diameter from 33 to 80 μm.

13. The method of producing the melt-anisotropic aromatic polyester multifilament according to claim 1, wherein the melt-anisotropic aromatic polyester multifilament includes single fibers having an average fiber diameter from 35 to 70 μm.

14. The method of producing the melt-anisotropic aromatic polyester multifilament according to claim 1, wherein the dimethylsilicone-series finishing agent has a viscosity from 300 to 2000 $mm^2/s$.

15. The method of producing the melt-anisotropic aromatic polyester multifilament according to claim 1, wherein the dimethylsilicone-series finishing agent has a viscosity from 300 to 1500 $mm^2/s$.

16. The method of producing the melt-anisotropic aromatic polyester multifilament according to claim 1, wherein the melt-anisotropic aromatic polyester multifilament comprises 4 to 6 wt % of the dimethylsilicone-series finishing agent based on the multifilament.

17. The method of producing the melt-anisotropic aromatic polyester multifilament according to claim 1, wherein the melt-anisotropic aromatic polyester multifilament has a single fiber fineness from 15 to 50 dtex.

18. The method of producing the melt-anisotropic aromatic polyester multifilament according to claim 1, wherein the melt-anisotropic aromatic polyester multifilament has an interfiber dynamic friction coefficient from 0.090 to 0.130.

19. The method of producing the melt-anisotropic aromatic polyester multifilament according to claim 1, wherein the melt-anisotropic aromatic polyester multifilament has a tenacity of 23 cN/dtex or higher.

20. The method of producing the melt-anisotropic aromatic polyester multifilament according to claim 1, wherein the melt-anisotropic aromatic polyester multifilament has a tenacity of 40 cN/dtex or lower.

* * * * *